United States Patent [19]

Annis et al.

[11] Patent Number: 4,842,505

[45] Date of Patent: Jun. 27, 1989

[54] APPARATUS FOR PRODUCING FIBROUS STRUCTURES ELECTROSTATICALLY

[75] Inventors: David Annis, Bromborough; John P. Berry, West Kirby, both of England

[73] Assignees: Ethicon, Somerville, N.J.; University of Liverpool

[21] Appl. No.: 28,519

[22] Filed: Mar. 20, 1987

[30] Foreign Application Priority Data

Mar. 24, 1986 [GB] United Kingdom ..... 8607235

[51] Int. Cl.[4] ..... B29B 13/08

[52] U.S. Cl. ..... 425/174.8 E; 264/26; 264/164

[58] Field of Search ..... 264/8, 10, 24, 26, 164, 264/DIG. 75; 425/8, 174.8, 174.8 E

[56] References Cited

U.S. PATENT DOCUMENTS

| | | | |
|---|---|---|---|
| 1,500,932 | 7/1924 | Hooper | 264/8 |
| 2,048,651 | 7/1936 | Norton | 264/10 |
| 2,109,333 | 2/1938 | Formhals | 264/10 |
| 2,433,000 | 12/1947 | Manning | 264/171 |
| 3,388,194 | 6/1968 | Vinicki | 264/8 |
| 4,127,706 | 11/1978 | Martin et al. | 264/DIG. 75 |
| 4,230,650 | 10/1980 | Guignard | 264/24 |
| 4,266,918 | 5/1981 | Manley | 425/174.8 E |
| 4,287,139 | 9/1981 | Guignard | 264/24 |
| 4,323,525 | 4/1982 | Bornat | 425/174.8 E |
| 4,552,707 | 11/1985 | How | 264/8 |
| 4,689,186 | 8/1987 | Bornat | 425/174.8 E |

FOREIGN PATENT DOCUMENTS

| | | |
|---|---|---|
| 2120946A | 12/1983 | United Kingdom . |
| 2121286A | 12/1983 | United Kingdom . |

OTHER PUBLICATIONS

University of Liverpool/Ethicon Inc., Panel Meeting–4th–5th Nov., 1985.

*Primary Examiner*—Jay H. Woo
*Assistant Examiner*—C. Scott Bushey
*Attorney, Agent, or Firm*—Robert L. Minier

[57] ABSTRACT

Apparatus for producing a fibrous structure including electrostatically charged mandrels arranged around a delivery assembly for fiberizable material. The delivery assembly includes capillary needles to which fiberizable material is supplied from a reservoir, the needles being arranged on manifolds moved continuously around a loop path on a rail.

2 Claims, 1 Drawing Sheet

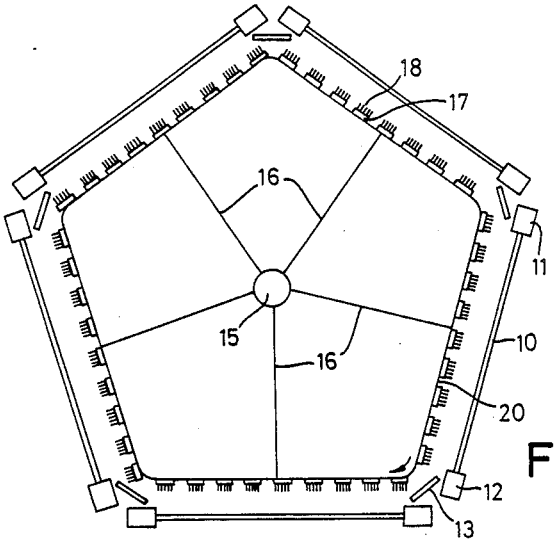
Fig. 1
Fig. 3
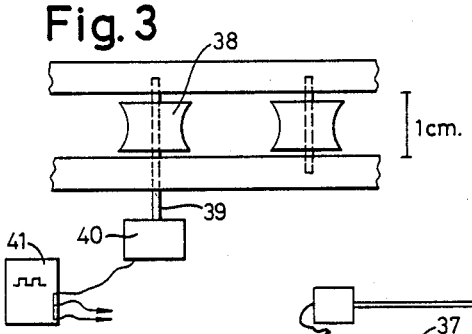
Fig. 2
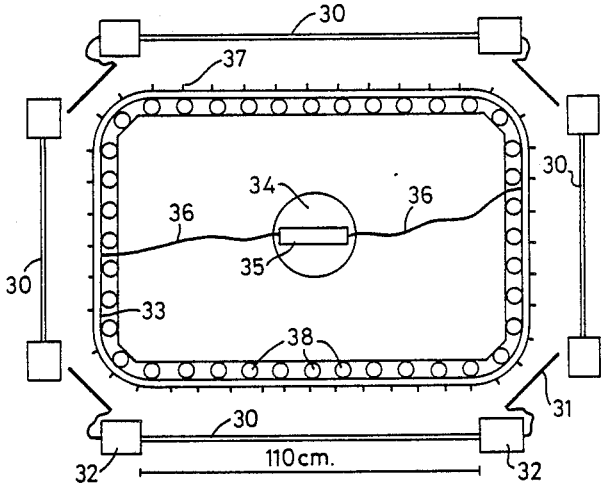

APPARATUS FOR PRODUCING FIBROUS STRUCTURES ELECTROSTATICALLY

FIELD OF THE INVENTION

The invention relates to the production of fibrous structures electrostatically, where an electrostatically charged collector has fiber-forming material such as a polymer in solution directed at it, and a fibrous structure is built up on the collector. More particularly, but not exclusively, the invention relates to electrostatic spinning where the collector is in the form of an electrostatically charged rotating mandrel.

SUMMARY OF THE INVENTION

According to the invention, there is provided apparatus for producing fibrous structures, which apparatus comprises a plurality of spaced apart fibre collectors electrostatically charged in use, and delivery means for delivering fiberizable material towards the collectors, which delivery means comprises a continuous delivery loop path, a multiplicity of ejection outlets for fiberizable material spaced apart along the loop path, means for supplying fiberizable material to the ejection outlets, and means for moving the outlets around the loop path to cause, in use, continuous movement of the ejection outlets past the collectors.

The ejection outlets may comprise a multiplicity of capillary elements, for example capillary needles.

The ejection outlets may be mounted in a multiplicity of manifolds. The means for moving the manifolds around the loop path may comprise an endless rail and means for moving the manifolds along the rail, which means may comprise an endless element such as a belt or chain, and drive means to drive the endless element.

Alternatively, the ejection outlets may be on a continuous tube loop, fiberzable material being supplied to the ejection outlets through the tube loop, and the means for moving the ejection outlets may comprise driven roller means in contact with the tube loop.

The ejection outlets may be simply holes in the tube loop.

The collectors may be static surfaces or rotatable mandrels. The collectors may be placed in any convenient configuration around the loop, and there may thus be a pair of collectors, three collectors arranged in a triangular configuration, four collectors arranged in a quadrilateral, or indeed any convenient number of collectors.

The apparatus may comprise electrostatically charged means in the regions of the ends of the collectors to provide a continuous electrostatic field around the loop path to attract material from the ejection outlets to avoid discontinuity in ejection. The electrostatically charged means may comprise plates.

The apparatus may comprise mounting means for the delivery means and the collectors, which mounting means allows relative movement of the delivery means and the collectors from a first position in which fiberizable material is directed towards the collectors, and a second position in which fiberizable material is no longer directed towards the collectors to allow changing of the collectors. The apparatus may comprise a dummy electrostatically charged grid on which fibers are collected in the second position.

BRIEF DESCRIPTION OF THE DRAWINGS

By way of example, two embodiments of apparatus according to the invention for producing fibrous structures electrostatically will now be described with reference to the accompanying drawings, in which:

FIG. 1 is a diagrammatic plan view of one embodiment of apparatus according to the invention;

FIG. 2 is a diagrammatic plan view of a second embodiment of apparatus according to the invention; and FIG. 3 is a view showing a detail of a driven wheel for driving a continuous tube.

DESCRIPTION OF THE PREFERRED EMBODIMENTS

FIG. 1 shows diagrammatically a plan view of apparatus for electrostatically spinning tubular fibrous structures which may be used, for example, as vascular grafts. Spinning of tubular vascular grafts using an electrostatic process is already known and reference is made to existing publications including our published U.K. Patent Application Nos. 2121286A and 2120946A which illustrate electrostatic spinning processes and make reference to other published literature.

The apparatus of FIG. 1 is designed to allow continuous and multiple production of tubular fibrous structures and the apparatus includes five elongate mandrels 10 each mounted in rotating chuck 11, 12, the mandrels 10 being electrostatically charged to a potential of several kilovolts, preferably in the range 6 kV to 20 kV. Between the chucks of adjacent mandrels are positioned charged guard plates 13. In this particular embodiment, the mandrels 10 are arranged in a pentagonal configuration and there are five guard plates 13.

Within the pentagonal configuration of mandrels 10 is arranged a delivery assembly for fiberizable material. The delivery assembly has a central reservoir 15 for fiberizable material such as a polymer in solution or other suitable material, feed pipes 16 leading from the central reservoir to a multiplicity of manifolds 17, each manifold 17 carrying a set of capillary needles 18. FIG. 1 being diagrammatic, five feed pipes 16 are shown but it will be appreciated that each manifold 17 must be supplied with fiberizable material and this may be achieved by an individual feed pipe 16 to each manifold 17 or branched feed pipes 16 feeding a group of manifolds 17. It will be appreciated that a variety of different arrangements for feeding fiberizable material could be used.

The manifolds 17 are arranged to run on a continuous fixed rail 20, the manifolds 17 being mounted for movement on a continuous chain or belt following the path of the rail 20. The chain or belt passes round sprockets or rollers respectively at corners of the pentagonal rail 20 and one or more of those sprockets or rollers (not shown) are driven to move the chain or belt and hence move the manifolds 17 around the rail 20.

Electrostatically charged grids (not shown) are preferably arranged in the region of the mandrels to assist in control of fibers emanating from the capillary needles 18 of the manifolds 17. Variations of the mandrel and grid potentials will alter the electrostatic field between the needles 18 and the mandrels 10 and can be used to control the way the fibrous structure is built up on the mandrels 10. A typical example of potentials would be 6 kV on the grids and 12 kV on the mandrels to produce a structure of fibers of a consistent diameter. Variation to 6.9 kV on the mandrels and 9.2 kV on the grids will alter the fibrous structure significantly. These voltages are by way of example only, and will vary on spacing variations and variations of mandrel diameter.

The electrostatic potential of the guard plates 13 will be the same or preferably higher than the electrostatic potential of the mandrels 10, the purpose of the guard plates 3 being to provide continuous attraction for fibers emanating from the needles 18 and thereby to avoid the needles blocking and spitting.

In use, the mandrels 10 are spun at a desired speed, usually several thousand revolutions per minute, and fiberizable material is supplied to the manifolds 17 as the manifolds 17 are moved around the continuous rail 20. Once a set of fibrous structures is completed, the rail 20 is raised above the level of the mandrels 10, conveniently by a distance of twelve inches. In this second position, there is a pentagonal electrostatically charged rail directly above the mandrels 10 on to which fibers emanating from the capillary needles 18 are directed, thereby maintaining an uninterrupted flow of polymer solution from the reservoir 15. The fibrous structures are removed from the mandrels 10 and fresh mandrels 10 are placed in position; with quick release chucks, this operation takes a few minutes only. The manifold rail 20 with the manifolds 17 still in motion is then lowered to the level of the mandrels 10 and the process is repeated.

FIG. 2 shows diagrammatically a second embodiment of apparatus for electrostatically producing fibrous structures. The FIG. 2 embodiment again employs collectors in the form of mandrels 30, this time arranged in a quadrilateral configuration with guard plates 31 in front of chucks 32. The guard plates 31 are at the same potential as or preferably a higher potential than the chucks 32 and mandrels 30.

In the FIG. 2 embodiment, the manifold arrangement of the FIG. 1 embodiment is replaced by a continuous tube 33 of suitable material such as plastics. The tube 33 is supplied with fiberizable material from a reservoir 34 via a pump 35 such as a syringe pump and feed lines 36. Short capillary needles 37, for example 1 cm long, are secured in the wall of the tube 33 such that fluid flowing through the tube 33 under pressure is ejected through the needles 37 to form fibers in the normal way attracted to the electrostatically charged mandrels 30.

As an alternative to the needles 37, accurately formed, small holes may be formed in the tube 33 to provide the ejection outlets for the fiberizable material.

The plastic tube is located in concave wheels or rollers 38, at least one and preferably several of which wheels 38 are driven to move the tube 33 around the closed loop shown in FIG. 2.

FIG. 3 illustrates an embodiment of a driven wheel 38, the wheel 38 being fixed for rotation on a shaft 39 driven by a stepper motor 40, a pulse generator 41 providing power for the stepper motor and for stepper motors associated with other driven wheels.

Driving of the tube 33 preferably relies on friction between the tube 33 and driven wheels 38 but if this is insufficient, the tube 33 may be circumferentially ribbed and corrugations or teeth may be formed on the driven wheels 38 to provide positive engagement.

Where the needles 37 are used in the tube 33, the needles 37 are preferably ½ inch (1.25 cm) long with a bore of 10/1000 of an inch (0.254 mm). Preheating the needles prior to insertion melts the plastics material around the needles thereby forming a firm seal around them.

A raising and lowering arrangement for the delivery assembly similar to that of the FIG. 1 embodiment is preferably provided so that flow through the needles 37 of holes in the tube 33 is continuous and so that clogging is prevented. Likewise, an arrangement of charged grids similar to that described in relation to the FIG. 1 embodiment will preferably be present.

The FIG. 2 embodiment has advantages that the delivery tube can be made quickly and simply and can be quickly replaced. Shutdown time would be reduced and the needles 37 would not need to be replaced. Furthermore, when a change is made from mandrels of one diameter to mandrels of another diameter so that a change of flow rate of fiberizable material is required, a complete delivery tube is simply replaced by one with a different number of needles or holes per unit length. Changes in size or shape of the assembly may easily be accommodated by fitting a tube of different length and different shapes may be used for the configuration of the mandrels. A traverse system including a series of free running wheels is easy to construct and maintain.

The foregoing description in relation to FIGS. 1 to 3 has shown the use of rotatable mandrels as collectors of fibers but it will be appreciated that these could equally be substituted by static collectors.

It may be necessary or desirable to reverse the direction of the manifolds 17 or tube 33 to achieve a desired fibrous structure. Movement control is conveniently achieved by a microprocessor.

It will of course be understood that the present invention has been described above purely by way of example, and modifications of detail can be made within the scope of the invention.

We claim:

1. Apparatus for continuously producing a plurality of individual tubular fibrous structures, which apparatus comprises a plurality of spaced apart fiber collectors, electrostatically charged in use, each of said collectors comprising a rotatable mandrel, and delivery means for delivering fiberizable material towards the collectors, which delivery means comprises a continuous delivery loop path, said collectors being disposed substantially uniformly outwardly of said delivery loop path, a multiplicity of ejection outlets for fiberizing materials spaced apart along the loop path, means for supplying fiberizable material to the ejection outlets, and means for moving the outlets around the loop path to cause, in use, continuous movement of the ejection outlets past the collectors, said collectors further comprising electrostatically charged means in the regions of the ends of the collectors to provide a continuous electrostatic field around the loop path to attract material from the ejection outlets to avoid discontinuity in ejection.

2. Apparatus as claimed in claim 1 comprising mounting means for the delivery means and the collectors, which mounting means allows relative movement of the delivery means and the collectors from a first position in which fiberizable material is directed towards the collectors, and a second position in which the fiberizable material is no longer directed towards the collectors to allow changing of the collectors and a dummy electrostatically charged grid on which fibers are collected in said second position.

* * * * *